US005797557A

United States Patent [19]

Wang et al.

[11] Patent Number: 5,797,557

[45] Date of Patent: Aug. 25, 1998

[54] APPARATUS, SYSTEMS AND METHODS FOR TRANSPORTING A CYLINDRICAL PACKAGE

[75] Inventors: Songhao Wang, Pittsburgh; William L. Schaefer, Butler, both of Pa.

[73] Assignee: PPG Industries, Inc., Pittsburgh, Pa.

[21] Appl. No.: 784,168

[22] Filed: Jan. 15, 1997

[51] Int. Cl.[6] ..... B65H 54/02; B65H 19/30; B65G 1/00; B66C 3/00

[52] U.S. Cl. ..... 242/35.5 A; 212/327; 242/533.3; 242/533.8; 242/559; 414/283; 414/331; 414/633; 414/785; 414/911

[58] Field of Search ..... 242/35.5 A, 559, 242/533.3, 533.7, 533.8; 414/331, 911, 283, 785, 633, 664, 347, 668; 212/327, 330, 333, 342, 336

[56] References Cited

U.S. PATENT DOCUMENTS

| | | | |
|---|---|---|---|
| 1,980,138 | 11/1934 | Johnson et al. . | |
| 2,579,700 | 12/1951 | Picton . | |
| 3,049,314 | 8/1962 | Criger . | |
| 3,077,317 | 2/1963 | Angst . | |
| 3,497,088 | 2/1970 | Lemelson | 414/283 X |
| 3,871,592 | 3/1975 | Kallenborn . | |
| 4,093,137 | 6/1978 | Briar et al. | 242/46.4 |
| 4,138,072 | 2/1979 | Aoyama et al. | 242/35.5 A |
| 4,154,412 | 5/1979 | Briar et al. | 242/46.4 |
| 4,390,647 | 6/1983 | Girgis . | |
| 4,415,304 | 11/1983 | Tripoli et al. . | |
| 4,538,954 | 9/1985 | Luebke | 414/633 |
| 4,541,769 | 9/1985 | Clemens | 414/633 |
| 4,591,106 | 5/1986 | Gay | 242/35.5 A X |
| 4,615,493 | 10/1986 | Teranishi et al. | 242/35.5 A |
| 4,718,813 | 1/1988 | Kehlenbach . | |
| 4,722,657 | 2/1988 | Grube | 414/283 X |
| 4,795,678 | 1/1989 | Girgis . | |
| 4,854,806 | 8/1989 | Gertsch et al. . | |
| 4,988,252 | 1/1991 | Yamamoto et al. | 242/35.5 A X |
| 5,274,984 | 1/1994 | Fukuda . | |

FOREIGN PATENT DOCUMENTS

| | | | |
|---|---|---|---|
| 4-75718 | 3/1992 | Japan | 242/559 |
| 922 055 | 4/1982 | U.S.S.R. | 414/785 |
| 1211213 | 2/1986 | U.S.S.R. | 414/785 |

OTHER PUBLICATIONS

K. Lowewenstein, "*The Manufacturing Technology of Continuous Glass Fibers*", (3d ed. 1993), pp. 30–44 47–60, 115, 122, 126–135, 165–172, 173, 177–180, 215–219, 237–291, 315.

*Encylcopedia of Polymer Science and Technology*, vol. 3 (1965), pp. 80–130; vol. 6 (1967), pp. 505–712.

(List continued on next page.)

*Primary Examiner*—Michael Mansen
*Attorney, Agent, or Firm*—Ann Marie Cannoni

[57] ABSTRACT

Apparatus and systems for transporting a generally cylindrical package include: (a) a frame including a support device having at least one compressible support member and a pivot device for pivoting the support device about a generally vertical axis, the support device being movable along the generally vertical axis between (1) a first predetermined position spaced apart from and below an outer surface of a generally cylindrical package which is removably telescoped upon a generally horizontal member of a support at a first predetermined location and (2) a second predetermined position in which the compressible support member contacts and supports at least a portion of the outer surface of the generally cylindrical package; and (b) a carriage assembly connected to and supporting the frame, the carriage assembly including a carriage for moving the frame between (1) a first predetermined position proximate the support and (2) a second predetermined position horizontally spaced apart from the first predetermined position such that the generally cylindrical package is removed from the first predetermined location upon the generally horizontal member of the support and transported to a second predetermined location horizontally spaced apart from the first predetermined location.

21 Claims, 7 Drawing Sheets

OTHER PUBLICATIONS

Webster's New Collegiate Dictionary (1977), p. 232.
R. Lewis, Sr., *Hawley's Condensed Chemical Dictionary*, (12th Ed. 1993) p. 455.
Kirk–Othmer, *Encyclopedia of Chemical Technology*, vol. 7 (1965) p. 676, vol., 9 (2dEd. 1966) pp. 847–884.
"ZRA2 Reaction Trolley", a Technical Bulletin (ZRA2–23) of Zimmerman International Corp. of Madison Heights, MI (Nov. 1994).
"End Truck Assembly", a Technical Bulletin (ZRA2–30) of Zimmerman International Corp. of Madison Heights, MI (Nov. 1994).
"ZRA2 Aluminum Rail", a Technical Bulletin (ZRA2–1) of Zimmerman International Corp. of Madison Heights, MI (Nov. 1994).
"Fiber Glass Spool Handling", a publication of Scaglia Italy.

APPARATUS, SYSTEMS AND METHODS FOR TRANSPORTING A CYLINDRICAL PACKAGE

FIELD OF THE INVENTION

The present invention relates to apparatus, systems and methods for transporting a package and, more particularly, to apparatus, systems and methods for removing a generally cylindrical package from a generally horizontal member of a support at a first predetermined location and mechanically transporting the package to a second predetermined location horizontally spaced apart from the first predetermined location.

BACKGROUND OF THE INVENTION

As raw material, labor and waste disposal costs escalate, technological advances provide a competitive means to increase productivity while decreasing cost. In labor intensive industries, advances in ergonomic or labor-saving technology can improve the work environment, as well as provide increased productivity and efficiency in manufacturing.

In the fiber glass industry, forming and roving operations, in which glass filaments and fiber strands, respectively, are wound into packages, are examples of labor intensive operations in which technological advances are needed. In the forming area, glass filaments are drawn at a high rate of speed from a fiber forming apparatus, or bushing, connected to a supply of molten glass. The filaments are gathered into one or more fibers and wound upon a rotating collet of a winder to create a generally cylindrical forming package. During winding, the collet rotates about a horizontal, longitudinal axis. Similarly, roving packages are formed by gathering a plurality of strands and winding the strands about a collet rotating about a horizontal, longitudinal axis.

Typical forming and roving packages weigh about 10 to about 250 kilograms and have diameters of about 0.18 meters to about 0.75 meters, making manual removal of the packages from the collet an unwieldy, inefficient and labor intensive process. An apparatus for lifting and transporting such packages is desirable to lessen the manual labor required and facilitate transportation of larger and heavier packages.

For handling wire coils, U.S. Pat. No. 1,980,138 discloses an apparatus including a carriage assembly having a support which can be moved vertically and transversely for removing a coil from a collapsible block. The carriage assembly runs upon tracks which are arranged parallel and adjacent to the blocks. An overhead crane running on elevated tracks can be used to lift the coil from the carriage assembly support and transport the coil to storage or another predetermined location.

U.S. Pat. No. 3,077,317 discloses an apparatus for handling a coil of strip material. The apparatus includes a collapsible coiling mandrel and a cooperating coil buggy. As discussed at column 1, lines 62–67, the buggy includes a platen, a double acting fluid pressure cylinder and piston for raising and lowering the platen, and another double-acting fluid pressure cylinder and piston for turning the platen about a vertical axis 90° from its predetermined position on the mandrel. Another cylinder displaces the buggy horizontally from the mandrel.

It is desirable to increase package size to increase productivity and decrease waste produced between winding of individual forming or roving packages. Apparatus and systems are needed which facilitate winding of larger wound packages and manipulation and transportation of any size of wound package to reduce labor and waste disposal costs and increase efficiency and productivity.

SUMMARY OF THE INVENTION

The present invention provides an apparatus for transporting a generally cylindrical package from a first predetermined location to a second predetermined location horizontally spaced apart from the first predetermined location, the apparatus comprising: (a) a frame comprising a support device comprising at least one compressible support member and a pivot device for pivoting the support device about a generally vertical axis, the support device being movable along the generally vertical axis between (1) a first predetermined position spaced apart from and below an outer surface of a generally cylindrical package which is removably telescoped upon a generally horizontal member of a support at a first predetermined location and (2) a second predetermined position in which the compressible support member contacts and supports at least a portion of the outer surface of the generally cylindrical package; and (b) a carriage assembly connected to and supporting the frame, the carriage assembly comprising a carriage for moving the frame between (1) a first predetermined position proximate the support and (2) a second predetermined position horizontally spaced apart from the first predetermined position such that the generally cylindrical package is removed from the first predetermined location upon the generally horizontal member of the support and transported to a second predetermined location horizontally spaced apart from the first predetermined location.

Another aspect of the present invention is an apparatus for transporting a generally cylindrical wound package from a first predetermined location to a second predetermined location horizontally spaced apart from the first predetermined location, the apparatus comprising: (a) a frame comprising a support device comprising at least one compressible support member and a pivot device for pivoting the support device about a generally vertical axis, the support device being movable along the generally vertical axis between (1) a first predetermined position spaced apart from and below an outer surface of a generally cylindrical wound package which is removably telescoped upon a generally horizontal collet of a winder at a first predetermined location and (2) a second predetermined position in which the compressible support member contacts and supports at least a portion of the outer surface of the generally cylindrical wound package; and (b) a carriage assembly connected to and supporting the frame, the carriage assembly comprising a carriage for moving the frame between (1) a first predetermined position proximate the winder and (2) a second predetermined position horizontally spaced apart from the first predetermined position such that the generally cylindrical package is removed from the first predetermined location upon the generally horizontal collet of the winder and transported to a second predetermined location horizontally spaced apart from the first predetermined location.

Another aspect of the present invention is a system for transporting a generally cylindrical package from a first predetermined location to a second predetermined location horizontally spaced apart from the first predetermined location, the system comprising: (a) a support having a generally horizontal member; (b) a generally cylindrical package which is removably telescoped upon at least a portion of the generally horizontal member of the support at a first predetermined location; (c) an apparatus for transporting the generally cylindrical package from the first predetermined location to a second predetermined location spaced apart from the first predetermined location, the apparatus comprising: (i) a frame comprising a support device comprising at least one compressible support member and a pivot device for pivoting the support device about a generally vertical axis, the support device being movable along the generally vertical axis between (1) a first predetermined position spaced apart from and below an outer surface of the generally cylindrical package and (2) a second predetermined position in which the compressible support member contacts and supports at least a portion of the outer surface of the generally cylindrical package; and (ii) a carriage assembly connected to and supporting the frame, the carriage assembly comprising a carriage for moving the frame between (1) a first predetermined position proximate the support and (2) a second predetermined position horizontally spaced apart from the first predetermined position such that the generally cylindrical package is removed from the first predetermined location upon the generally horizontal member of the support and transported to a second predetermined location horizontally spaced apart from the first predetermined location.

Another aspect of the present invention is an apparatus for transporting a generally cylindrical package from a first predetermined location to a second predetermined location horizontally spaced apart from the first predetermined location, the apparatus comprising: (a) a frame comprising a support device comprising a plurality of extendible support members and a pivot device for pivoting the support device about a generally vertical axis, the support device being movable along the generally vertical axis between (1) a first predetermined position spaced apart from and below an outer surface of a generally cylindrical package which is removably telescoped upon a generally horizontal member of a support at a first predetermined location and (2) a second predetermined position in which the extendible support members are extended to contact and support at least a portion of the outer surface of the generally cylindrical package; and (b) a carriage assembly connected to and supporting the frame, the carriage assembly comprising a carriage for moving the frame between (1) a first predetermined position proximate the support and (2) a second predetermined position horizontally spaced apart from the first predetermined position such that the generally cylindrical package is removed from the first predetermined location upon the generally horizontal member of the support and transported to a second predetermined location horizontally spaced apart from the first predetermined location.

Another aspect of the present invention is a system for transporting a generally cylindrical package from a first predetermined location to a second predetermined location horizontally spaced apart from the first predetermined location, the system comprising: (a) a support having a generally horizontal member; (b) a generally cylindrical package removably telescoped upon at least a portion of the generally horizontal member; (c) an apparatus for transporting the generally cylindrical package from a first predetermined location to a second predetermined location horizontally spaced apart from the first predetermined location, the apparatus comprising: (i) a frame comprising a support device comprising a plurality of extendible support members and a pivot device for pivoting the support device about a generally vertical axis, the support device being movable along the generally vertical axis between (1) a first predetermined position spaced apart from and below an outer surface of the generally cylindrical package and (2) a second predetermined position in which the extendible support members are extended to contact and support at least a portion of the outer surface of the generally cylindrical package; and (ii) a carriage assembly connected to and supporting the frame, the carriage assembly comprising means for moving the frame between (1) a first predetermined position proximate the support and (2) a second predetermined position horizontally spaced apart from the first predetermined position such that the generally cylindrical package is removed from the first predetermined location upon the generally horizontal member of the support and transported to a second predetermined location horizontally spaced apart from the first predetermined location.

Another aspect of the present invention is a method for transporting a generally cylindrical package from a first predetermined location to a second predetermined location horizontally spaced apart from the first predetermined location, comprising the steps of: (a) providing a generally cylindrical package removably telescoped upon a generally horizontal member of a support at a first predetermined location; (b) positioning a support device of a transport apparatus at a predetermined position spaced apart from and below an outer surface of the generally cylindrical package, the support device comprising at least one compressible support member; (c) moving the support device from the predetermined position in a first direction along a generally vertical axis such that the compressible support member contacts and supports at least a portion of the outer surface of the generally cylindrical package at a second predetermined position; (d) moving the support device from the second predetermined position in a second direction along a generally horizontal axis away from the support such that the generally cylindrical package is removed from the support; (e) pivoting the support device about a generally vertical axis at a predetermined angle; (f) positioning at least a portion of the generally cylindrical package upon a support at a third predetermined position; and (g) releasing the generally cylindrical package from the support device, such that the generally cylindrical package is transported to a second predetermined location horizontally spaced apart from the first predetermined location.

Another aspect of the present invention is a method for transporting a generally cylindrical package, comprising the steps of: (a) providing a generally cylindrical package removably telescoped upon a generally horizontal member of a support at a first predetermined location; (b) positioning a support device of a transport apparatus at a predetermined position spaced apart from and below an outer surface of the generally cylindrical package, the support device comprising a plurality of extendible support members; (c) moving the support device from the predetermined position in a first direction along a generally vertical axis such that the extendible support members contact at least a portion of the outer surface of the generally cylindrical package at a second predetermined position; (d) extending the extendible support members contact such that the extendible support members support at least a portion of the outer surface of the generally cylindrical package; (e) moving the support device from the second predetermined position in a second direction along a generally horizontal axis away from the support such that the generally cylindrical package is removed from the support; (f) pivoting the support device about a generally vertical axis at a predetermined angle; (g) positioning at least a portion of the generally cylindrical package upon a support at a third predetermined position; and (h) releasing the generally cylindrical package from the support device, such that the generally cylindrical package is transported to a second predetermined location horizontally spaced apart from the first predetermined location.

BRIEF DESCRIPTION OF THE DRAWINGS

The foregoing summary, as well as the following detailed description of the preferred embodiments, will be better understood when read in conjunction with the appended drawings. In the drawings.

DETAILED DESCRIPTION OF THE INVENTION

The apparatus, systems and methods of the present invention represent an economical, ergonomically desirable technological advance which provides increased productivity and efficiency by facilitating transportation of heavy and cumbersome generally cylindrical packages, such as wound packages of fibers.

To better understand the aforesaid important aspects of the invention, a glass fiber forming operation in which such apparatus, systems and methods are useful will first be discussed. One skilled in the art would understand that the apparatus, systems and methods of the present invention are not intended to be limited to use in glass fiber forming, but are useful in operations for transporting a wide variety of generally cylindrical packages including wound packages of natural and man-made fibers or sheet material, as discussed in detail below.

Figure 1:
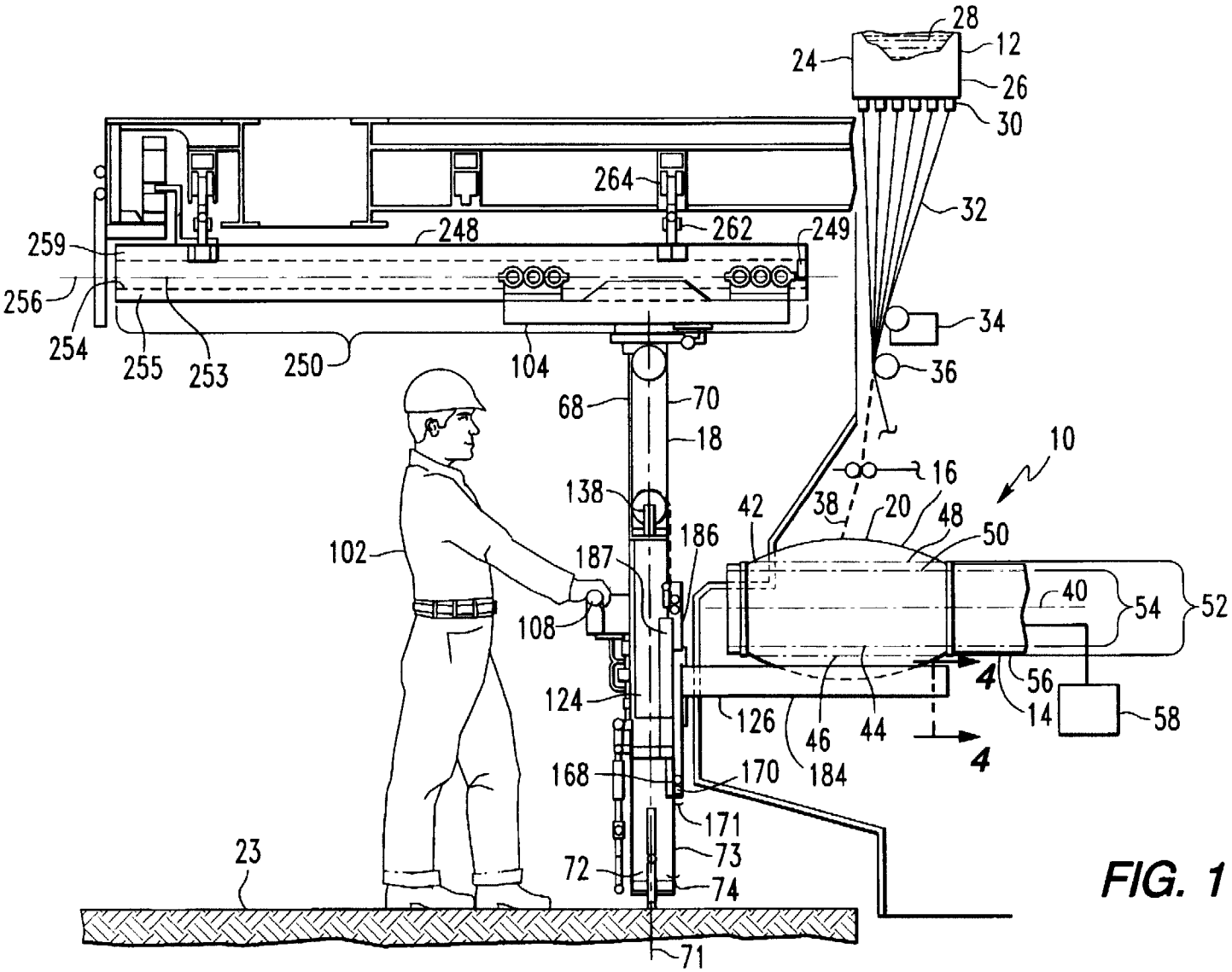
FIG. 1 is a schematic side elevational view of a preferred apparatus and system for transporting a generally cylindrical package, in accordance with the present invention.

Referring to the drawings, wherein like numerals indicate like elements throughout, there is shown in FIG. 1 a system, generally designated 10, comprising one or more fiber supplies 12, one or more winders 14 for winding a generally cylindrical forming package 16 from each respective fiber supply 12, and a transport apparatus 18 for transporting each forming package 16 between a first predetermined location 20 and a second predetermined location 22 (shown in FIG. 6) horizontally spaced apart from the first predetermined location 20, in accordance with the present invention. As used herein, the term "horizontal(ly)" means that the orientation of the element or the direction of movement is generally parallel with respect to ground 23. As used herein, the term "vertical(ly)" means that the orientation of the element or the direction of movement is generally perpendicular with respect to ground 23.

The fiber supply 12 is preferably a fiber forming apparatus 24 (shown in FIG. 1) which comprises a glass melting furnace or forehearth 26 containing a supply of a fiber forming mass or molten glass 28 and having a precious metal bushing 30 or spinneret attached to the bottom of the forehearth 26. Alternatively, the fiber forming apparatus 24 can be, for example, a forming device for synthetic textile fibers or strands.

As shown in FIG. 1, the bushing 30 is provided with a series of orifices in the form of tips through which molten glass is drawn in the form of individual fibers 32 or filaments at a high rate of speed. The glass fibers 32 can be cooled by spraying with water (not shown) and then coated with a sizing by an applicator 34. The preferred applicator 34 is a graphite roll applicator as shown in FIG. 1. Other examples of suitable applicators 34 are disclosed in K. Loewenstein, *The Manufacturing Technology of Glass Fibres*, (3d Ed. 1993) at pages 165–172, which are hereby incorporated by reference.

After application of the sizing, the glass fibers 32 are gathered by an alignment device 36 which aligns each of the fibers 32 to form one or more strands 38 in which each of the fibers 32 is generally adjacent and coplanar (in side-by-side or generally parallel alignment). Non-limiting examples of suitable alignment devices include rotatable or stationary gathering shoes or a comb, as discussed in Loewenstein at page 173, which is hereby incorporated by reference. Preferably, the number of strands 38 ranges from 1 to about 10 strands and, more preferably, 1 to about 6 strands. Alternatively, the strands 38 can be gathered from a plurality of adjacent bushings.

Figure 7:
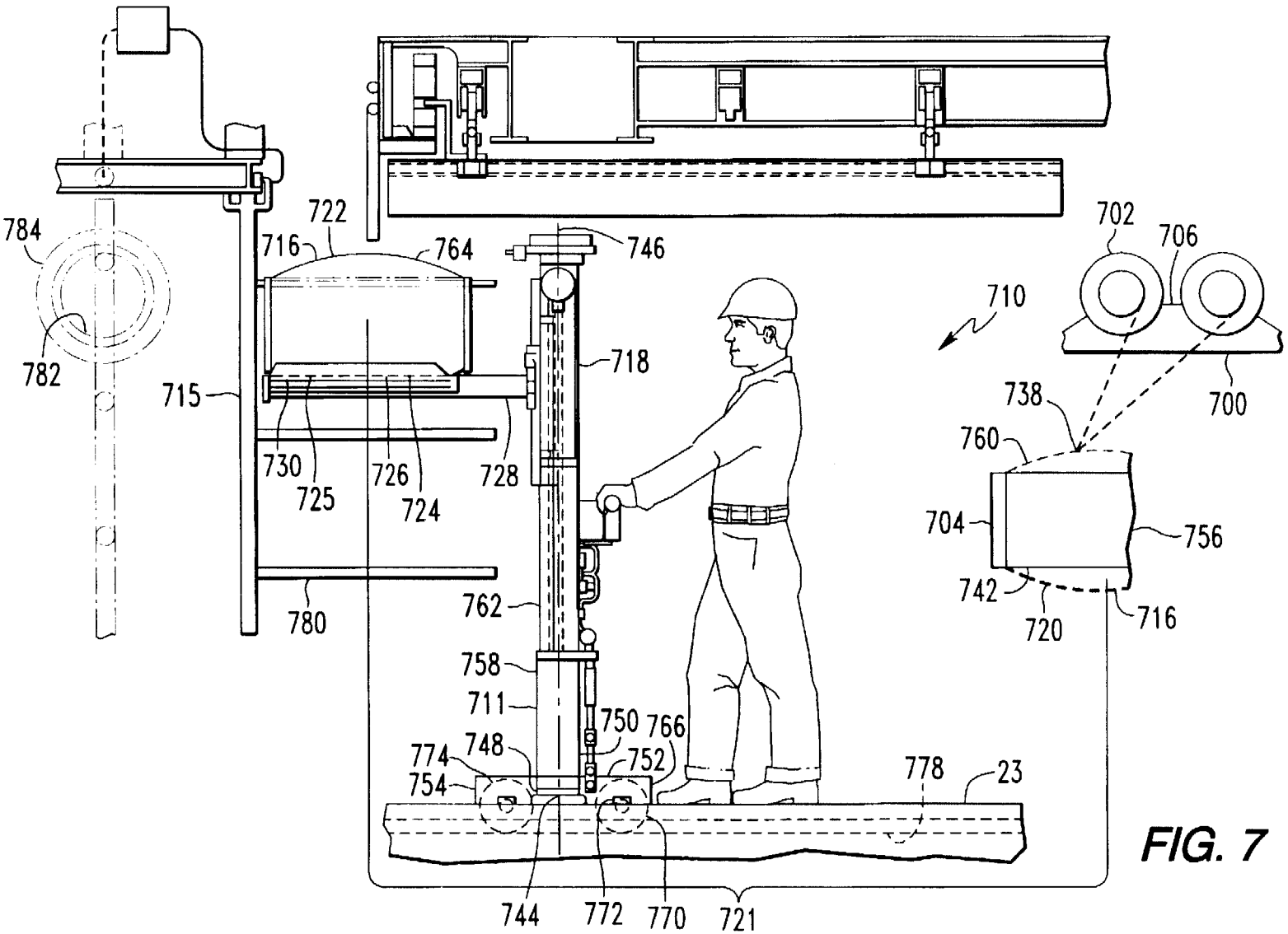
FIG. 7 is a schematic side elevational view of an alternative embodiment of an apparatus and system for transporting a generally cylindrical package, in accordance with the present invention.
Figure 10:
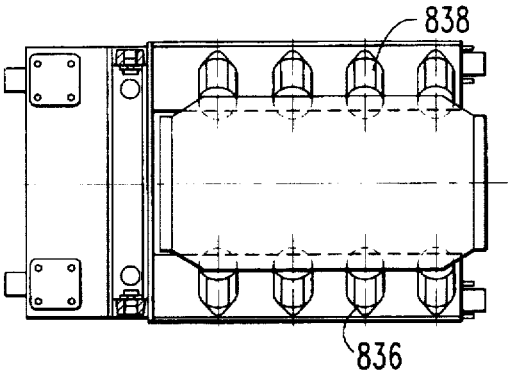
FIG. 10 is a top plan view of the apparatus of FIG. 8.
Figure 11:
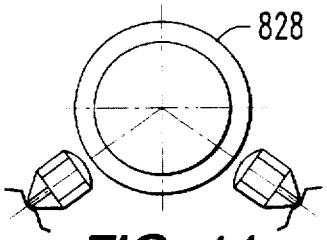
FIG. 11 is an end view of a portion of the apparatus of FIG. 8 showing the piston and cylinder arrangement in the first predetermined position.
Figure 12:
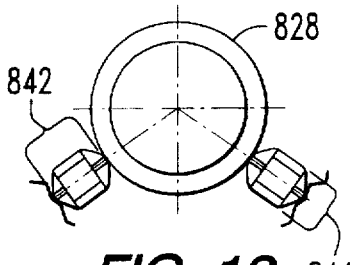
FIG. 12 is an end view of a portion of the apparatus of FIG. 8 showing the piston and cylinder arrangement in the second predetermined position.

In an alternative embodiment shown in FIG. 7, in a roving operation the fiber supply can be a plurality of forming or supply packages 702 mounted upon a creel 700. The supply packages 702 can be wound such that the strand 738 can be withdrawn from the inside of the supply package 702 or preferably from the outside of the supply package 702 (known in the art as "filling wind"). The dimensions of the supply package 702 can vary, depending upon such variables as the diameter and type of fiber wound thereon, and are generally determined by convenience for later handling and processing. Generally, supply packages 702 are about 15.2 to about 76.2 centimeters (about 6 to about 30 inches) in diameter and have a length of about 12.7 to about 101.6 centimeters (about 5 to about 40 inches).

Referring to FIG. 7, each supply package 702 is held by a support member 704 of a frame 706 of the creel 700. Conventional creels suitable for use in the system 710 are shown in Loewenstein at page 315, which is hereby incorporated by reference.

Figure 2:
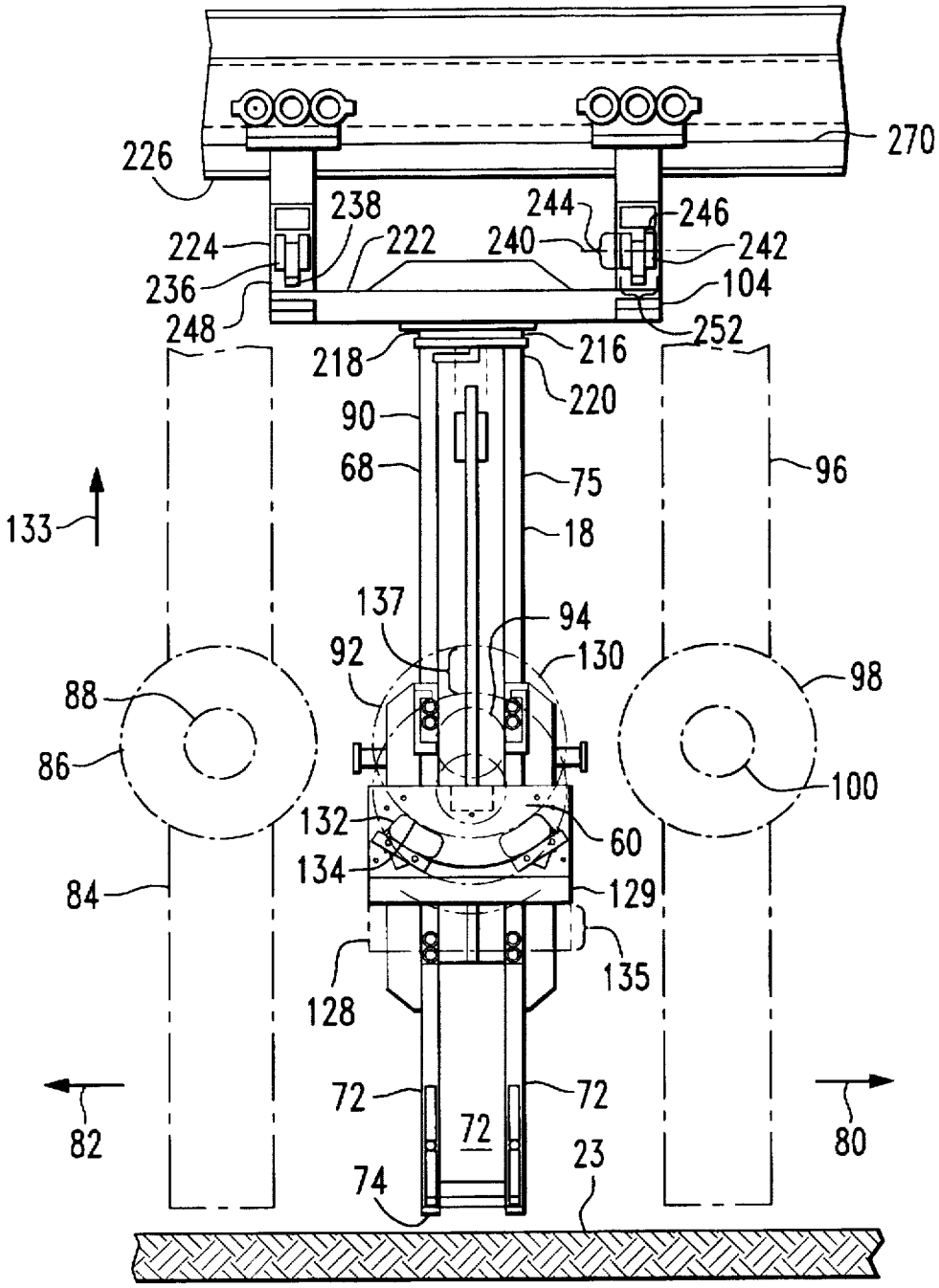
FIG. 2 is a schematic front elevational view of a portion of the apparatus of FIG. 1 showing the support device in the first, lowered predetermined position.

Referring now to FIGS. 1 and 2, in a preferred embodiment the system 10 comprises one or more supports or winders 14, each winder 14 for receiving the strands 38 from the corresponding alignment device 36, advancing and applying a tension to the strands 38, and forming the strands 38 into a wound package 16 about a central longitudinal rotational axis 40 of a collet 42 of the winder 14. Preferably, the winder collets 42 are arranged in a generally parallel series, as shown in phantom in FIG. 2.

Referring now to FIG. 1, the support or winder 14 has one or more generally horizontal members, preferably a collet 42 comprising a mandrel 44 having a generally cylindrical surface 46 which receives the strands 38 from the alignment device 36 and about which the strands 38 are wound to form a forming package 16. The mandrel 44 is preferably radially expandable and has a first, expanded predetermined position 48 (shown in phantom) for engaging and retaining the forming package 16 upon the collet 42 and a second, collapsed predetermined position 50 for releasing the forming package 16 from the mandrel 44. The mandrel 44 can be radially expanded by the centrifugal force generated by the rotating collet and collapsed by ceasing rotation of the collet. Alternatively, compressed air can be used to expand a plurality of retainers or fingers positioned radially about the periphery of the mandrel for retaining the package 16. Other methods and apparatus for expanding and collapsing the collet 42 are well known to those skilled in the art and further discussion thereof is not believed to be necessary in view of the present disclosure. For more information, a general discussion of expandable collets and forming winders is given in Loewenstein at pages 177–180 and U.S. Pat. Nos. 3,871,592, 4,093,137 and 4,154,412 which are hereby incorporated by reference. Non-limiting examples of suitable collets include those which are commercially available from Dietze & Schell Maschinenfabrik Gmbh of Coburg, Germany and Precision Machine Works of South Carolina.

As shown in FIG. 1, the mandrel 44 has a first diameter 52 when in the first, expanded position 48 and a second diameter 54 which is less than the first diameter 52 when in the second, collapsed position 50. Preferably, the first diameter 52 ranges from about 0.15 to about 0.51 meters (about 6 to about 20 inches). The second diameter 54 preferably ranges from about 0.15 to about 0.5 meters (about 5.75 to about 19.75 inches). The first diameter 52 and second diameter 54 can vary, based upon such factors as the type of winder 14 and the desired inner diameter of the wound package 16.

The collet 42 is mounted upon a shaft 56 and rotated by a motor assembly 58. The motor assembly 58 preferably comprises a variable speed motor such as are well known to those skilled in the art. In the preferred embodiment the motor assembly 58 is an inverted motor which rotates the collet 42 about a stationary shaft. The stationary shaft is surrounded by a stator element (not shown) and a rotor (also not shown). The windings of the stator are connected to a suitable power source, such as a conventional alternating current motor of about 5 to about 50 horsepower. Alternatively, the motor assembly can be used to rotate a shaft which in turn rotates the collet 42.

The mandrel 44 and other components of the collet 42 are typically constructed from lightweight materials to permit rapid acceleration and deceleration of the collet, such as aluminum, steel and alloys thereof, and preferably 6061-T6 aluminum alloy.

Figure 6:
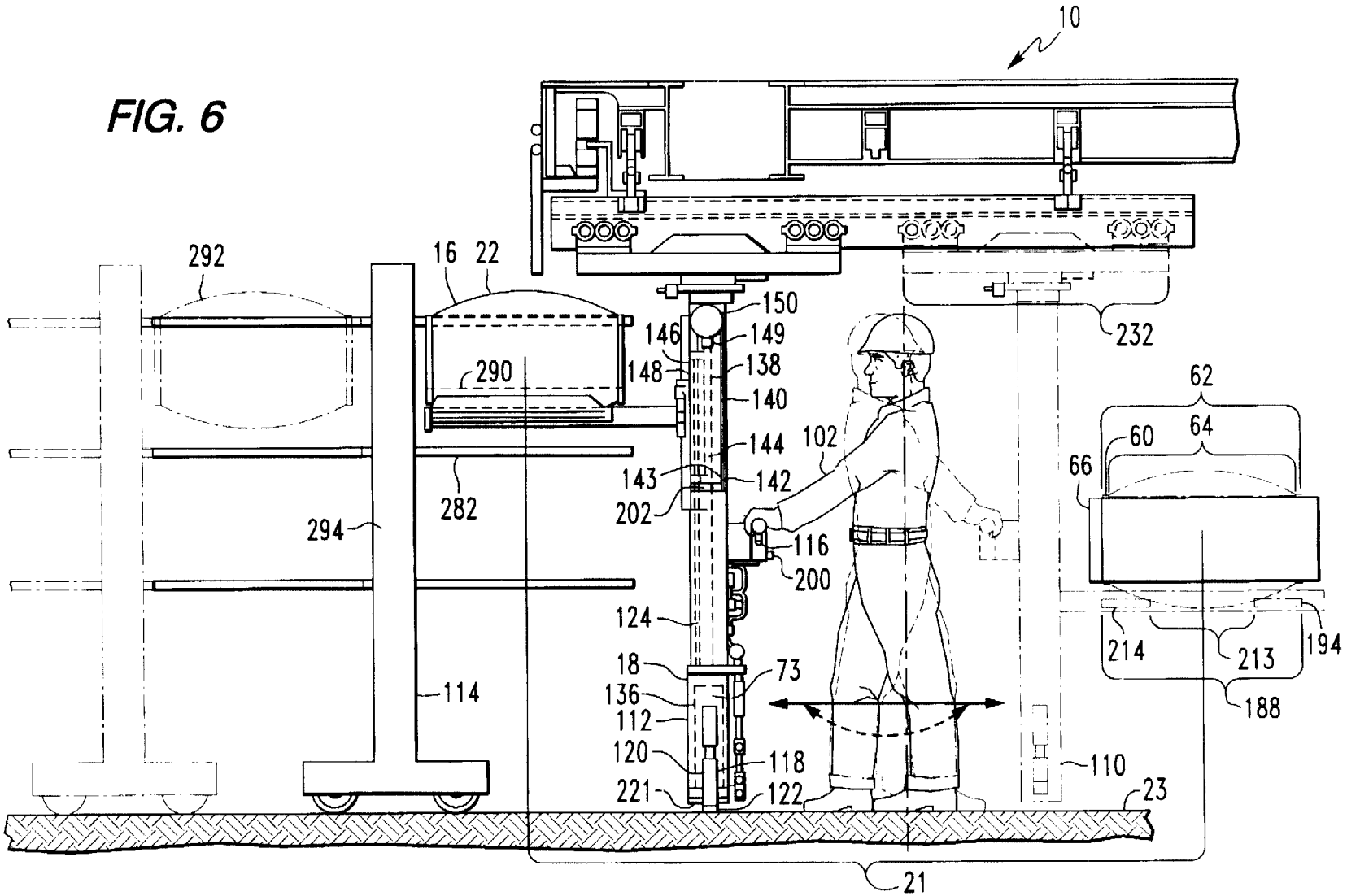
FIG. 6 is a schematic side elevational view of the preferred apparatus and system for transporting a generally cylindrical package, in accordance with the present invention.

Referring now to FIG. 6, the forming package 16 is preferably wound upon a tubular support or forming tube 60 which is removably telescoped upon the mandrel 44. Suitable materials for forming the forming tube 60 include a variety of materials well known to those skilled in the art, such as thermoplastic materials and cardboard. As shown in FIG. 6, the forming tube 60 has a length 62 which is preferably slightly longer than the desired length 64 of the forming package 16, yet preferably does not extend over the endcap 66. The inner diameter of the forming tube 60 is generally equal to or slightly greater than the first, expanded diameter 52 of the mandrel 44 to facilitate removal of the forming tube 60 and forming package 16 wound thereon.

As discussed generally above, the systems 10, 710 of the present invention include a generally cylindrical package to be transported, such as a wound package of sheet material, a roving package (shown in FIGS. 8–12) or preferably a forming package 16 (shown in FIGS. 1–6) comprising a plurality of wound fibers 24 or strands 38. The dimensions of the forming package 16 are similar to those of the supply package 702 set forth above.

The present invention is generally useful for transporting packages of wound fibers, strands, yarns or the like of natural or man-made materials. As used herein, the term "fibers" means a plurality of individual filaments. The term "strand" as used herein refers to a plurality of fibers. Fibers believed to be useful in the present invention and methods for preparing and processing such fibers are discussed at length in the *Encyclopedia of Polymer Science and Technology*, Vol. 6 (1967) at pages 505–712, which is hereby incorporated by reference.

Suitable natural fibers include those derived directly from animal, vegetable and mineral sources. Suitable natural inorganic fibers include glass and polycrystalline fibers, such as ceramics including silicon carbide, and carbon or graphite.

The preferred fibers for use in the present invention are glass fibers, a class of fibers generally accepted to be based upon oxide compositions such as silicates selectively modified with other oxide and non-oxide compositions. Useful glass fibers can be formed from any type of fiberizable glass composition known to those skilled in the art, and include those prepared from fiberizable glass compositions such as "E-glass", "A-glass", "C-glass", "D-glass", "R-glass", "S-glass", and E-glass derivatives that are fluorine-free and/or boron-free. Preferred glass fibers are formed from E-glass. Such compositions and methods of making glass filaments therefrom are well known to those skilled in the art and further discussion thereof is not believed to be necessary in view of the present disclosure. If additional information is needed, such glass compositions and fiberization methods are disclosed in Loewenstein at pages 30–44, 47–60, 115–122 and 126–135, which are hereby incorporated by reference.

Non-limiting examples of suitable animal and vegetable-derived natural fibers include cotton, cellulose, natural rubber, flax, ramie, hemp, sisal and wool. Suitable man-made fibers can be formed from a fibrous or fiberizable material prepared from natural organic polymers, synthetic organic polymers or inorganic substances. As used herein, the term "fiberizable" means a material capable of being formed into a generally continuous filament, fiber, strand or yarn. Preferably, the fibers are essentially free of metallic fibers, such as aluminum, steel and copper. *See Encyclopedia of Polymer Science and Technology*, Vol. 6 at 569–570.

It is understood that blends or copolymers of any of the above materials and combinations of fibers formed from any of the above materials can be used in the present invention, if desired.

Preferably, one or more coating compositions, such as a sizing composition, are present on at least a portion of the surfaces of the glass fibers to protect the surfaces from abrasion during processing. As used herein, the terms "size", "sized" or "sizing" refer to the aqueous composition applied to the filaments immediately after formation of the glass fibers.

Typical sizing compositions can include as components film-formers, lubricants, coupling agents and water, to name a few. Examples of suitable sizing compositions are set forth in Loewenstein at pages 237–291 and U.S. Pat. Nos. 4,390,647 and 4,795,678, each of which is hereby incorporated by reference. The sizing can be applied in many ways, for example by contacting the filaments with a static or dynamic applicator, such as a roller or belt applicator discussed above, spraying or by other means well known to those skilled in the art.

Care must be taken while removing the forming package 16 from the winder 14 and during subsequent handling of the forming package 16 to prevent damage to the outer layers of glass fibers 32 wound thereon. The systems 10, 710, 802 and transport apparatus 18, 718, 800 of the present invention inhibit damage to the outer layers of the forming package 16, 716, 828 during removal of the forming package 16, 716, 828 from the support or winder 14, 756 and subsequent transportation of the forming package 16, 716, 828.

As shown in FIGS. 1–12, the systems 10, 710, 802 comprise a mechanical transport apparatus 18, 718, 800 for removing the forming package 16, 716, 828 from the support or winder 14, 756 and transporting the forming package 16, 716, 828. The transport apparatus 18, 718, 800 removes the wound package 16, 716, 828 from the generally horizontal member or collet 42, 742 at a first predetermined location 20, 720 and transports the wound package 16, 716 to a second predetermined location 22, 722 horizontally spaced apart from the first predetermined location 20, 720 by a distance 21, 721. The distance 21, 721 between the first predetermined location 20 and the second predetermined location can vary as desired, but preferably ranges from about 1 to about 20 meters. For clarity, the discussion of the transport apparatus will refer to transport apparatus 18, however it is understood that this discussion also pertains to transport apparatus 718, which is essentially the same as transport apparatus 18. Transport apparatus 800 will be discussed in detail below.

The transport apparatus 18 comprises a frame 68 formed from a rigid material, such as aluminum or preferably stainless steel. The frame 68 comprises one or more central support column(s) 70. The shape, dimensions and material from which the support column 70 is formed can vary based upon such factors as the weight and dimensions of the wound package 16 to be transported. The shape of the support column 70 can be generally cylindrical or tubular or generally square or I-shaped in cross-section, as desired. Preferably, the support column 70 is oriented such that a longitudinal axis 71 of the support column 70 is generally vertically oriented with respect to the ground 23. The preferred support column 70 is generally U-shaped in cross-section, as shown in FIGS. 1 and 2, and has a plurality of generally perpendicular walls 72 and flanges 75 extending generally perpendicularly from the side walls 73 of the support column 70. The thickness 74 of each wall can independently range from about 1.5 to about 6 millimeters (mm), and preferably is about 3.2 mm (about ⅛th inch).

Figure 5:
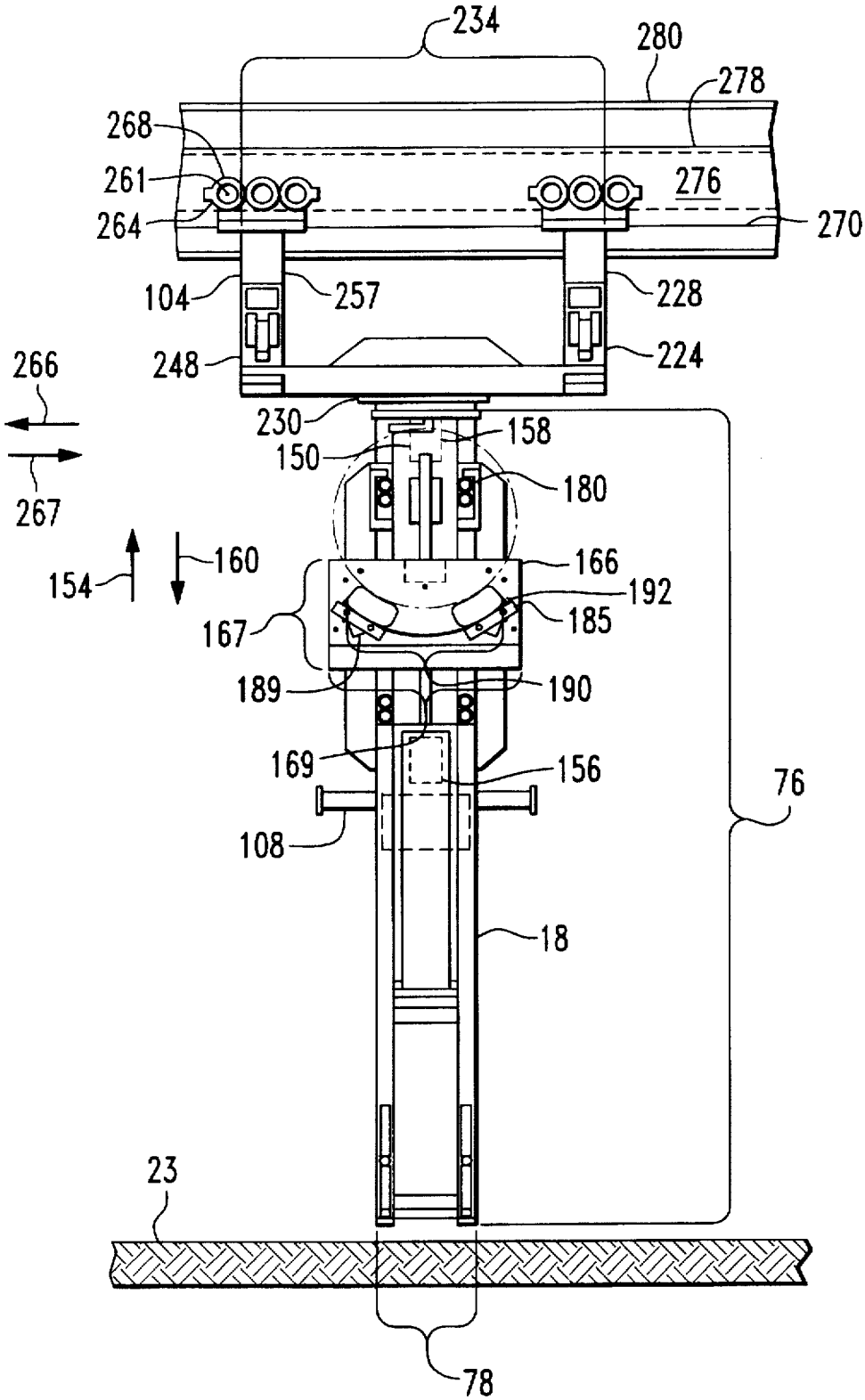
FIG. 5 is a schematic front elevational view of a portion of the apparatus of FIG. 1 showing the support device in the second, elevated predetermined position.

As shown in FIG. 5, the overall length 76 of the support column 70 can range from about 1.9 to about 3 meters, and is preferably about 1.9 meters (about 73 inches). The overall width 78 of the support column 70 can range from about 0.1 to about 0.3 meters, and is preferably about 0.15 meters (about 6 inches).

Referring now to FIG. 2, the support column 70 is preferably moveable between winders 14 in a direction 80 and an opposed direction 82 such that the support column 70 can be aligned with each winder 14 to remove the respective wound package 16 telescoped thereon. For example, the support column 70 can be moved in the direction 80 from (1) a first predetermined position 84 (shown in phantom) for removing and transporting a first wound package 86 from a first winder 88 to (2) a second predetermined position 90 for removing and transporting a second wound package 92 from a second winder 94 or (3) third predetermined position 96 for removing and transporting a third wound package 98 from a third winder 100. Similarly, the support column 70 can be moved in the opposite direction 82 from the third predetermined position 96 for removing and transporting the third wound package 98 from the third winder 100 to a second predetermined position 90 or first predetermined position 84 for removing and transporting first and second wound packages 86, 92 from the first and/or second winders 88, 94. The positions 84, 90 and 96 are determined by the operator 102 based upon the position of the collet of each winder 88, 94, 100.

The support column 70 can be moved manually by the operator 102 exerting a force upon the support column 70 generally in the direction 80 or opposite direction 82 to move the support column 70 in the corresponding direction 80, 82, as desired. The carriage assembly 104 for guiding movement of the support column 70 will be discussed in detail below.

As shown in FIG. 5, the support column 70 can comprise a set of handles 108 positioned upon the support column 70 at a convenient, ergonomically efficient height to facilitate operator movement of the support column 70. Alternatively or additionally, an automated device such as a pneumatic, hydraulic or motorized system can be provided for moving the column in response to an operator's 102 signal, such systems being well known to those skilled in the art.

As shown in FIG. 6, the support column 70 is moveable between (1) a first predetermined position 110 proximate the support or winder 14 for removing the wound package 16 from the winder 14 at the first predetermined location 20 and (2) a second predetermined position 112 horizontally spaced apart from the first predetermined position 110 and winder 14 at which the wound package 16 can be unloaded from the transport apparatus 18 at the second predetermined location 22 onto a storage device such as cart 114 shown in FIG. 6) or conveyor 715 (shown in FIG. 7) for further transport or storage, as discussed in detail below.

As shown in FIG. 6, the support column 70 preferably has connected hereto a braking device 118 for inhibiting movement of the support column 70 when the transport apparatus 18 is not being used to move the wound packages 16 horizontally with respect to ground, for example during removal of a wound package 16 from the winder 14 or loading of the wound package 16 onto the storage device.

Preferably the braking device 118 comprises one or more, preferably two, hydraulic or pneumatic piston and cylinder arrangements 120 connected to opposed side walls 73 of the support column 70 and a stop 122, such as a rubber endpiece, connected to the bottom end 221 of the support column 70. The braking device 118 can include a lever 116 connected to the support column 70 by which the operator 102 can actuate the braking device 118. When actuated manually or automatically by a signal from the operator 102, the piston and cylinder arrangement 120 moves the stop 122 into contact with the ground 23 or an object (not shown) for inhibiting movement of the transport apparatus 18. Suitable piston and cylinder arrangements include air actuated cylinders such as Model 6W105 which is commercially available from W. W. Grainger, Inc. of Chicago, Ill. The air supply to the piston and cylinder arrangement 120 preferably ranges from about $2.8\times10^5$ to about $6.2\times10^5$ Pascals (about 40 to about 90 pounds per square inch absolute (psia)).

One skilled in the art would understand that other braking devices well known to those skilled in the art can be used to inhibit movement of the transport apparatus 18.

Referring now to FIGS. 1 and 2, the transport apparatus 18 comprises a lifting device, preferably comprising one or more piston and cylinder arrangements 124, for moving a support device 126 (discussed below) which supports the forming package 16 during transport between (1) a first predetermined position 128 spaced apart from and below an outer surface 130 of the forming package 16 which is in the first predetermined location 20, i.e., telescoped upon the collet 42, and (2) a second predetermined position 129 in which a compressible support member 132 of the support device 126 contacts and supports at least a portion 134 of the outer surface 130 of the forming package 16 to lift the forming package 16 in a generally vertical direction 133 for removal of the forming package 16 from the winder 14.

The distance 135 between the first predetermined position 128 and the second predetermined position 129 of the support device 126 should be sufficient to displace the forming package 16 a corresponding distance 137 in the generally vertical direction 133 to permit the forming package 16 to be removed from the collet 42 with minimal damage to the outer layers of the forming package 16. Preferably, the distance 135 ranges from about 1 to about 10 millimeters, and more preferably about 4 to about 7 millimeters.

The piston and cylinder arrangement 124 is preferably a single hydraulic or pneumatic piston and cylinder arrangement having sufficient capacity to lift the weight of the forming package 16. The piston and cylinder arrangement 124 is connected to a portion of the support column 70 and a portion of the support device 126. As shown in FIG. 6, the preferred piston and cylinder arrangement 124 is an air over oil piston and cylinder arrangement 124 having an oil-filled reservoir tank 136 and a cylinder 144 for receiving the oil displaced from the tank 136, the cylinder including a moveable piston 138 having a rod 149 connected at an end thereof. If desired, the piston and cylinder arrangement 124 can be protected from the environment by a cover (not shown for purposes of clarity in the drawings).

Suitable air over oil piston and cylinder arrangement are commercially available from Hydro-Line Company of Rockford, Ill. The preferred air on oil tank 136 is Model No. QT 516 (commercially available from Hydro-Line) which has a 127 millimeter (mm) (5 inch) bore and 406 mm (16 inch) length. The diameter of the preferred Model No. Q5L-4X19 cylinder (commercially available from Hydro-Line) is 101 mm (4 inches) and the length is 483 mm (19 inches).

To extend the piston 138 to move the forming package 16 upwards, the operator 102 actuates an air switch 200 which actuates a pilot operated solenoid power switch which supplies air to the top of tank 136 to permit oil in the tank 136 to be displaced into the bottom of the cylinder 144 which in turn extends the piston 138. When the support device 126 reaches the second position 129 and contacts the outer surface 130 of the forming package 16, the operator 102 releases the switch 200 which closes check valve 202 between the tank 136 and cylinder 144 to prevent the oil from reflowing from the cylinder 144 into the tank 136, and the tank 136 is vented. The weight of the forming package 16 is at least partially supported by the support device 126 to permit the forming package 16 to be removed from the winder collet 42. Since the oil is essentially non-compressible, when the forming package is removed from the winder 14, the weight of the forming package 16 is essentially fully supported by the support device 126 with minimal upward or downward movement, i.e., bouncing, of the forming package 16, which provides stability during transportation of the package 16. The air pressure required to support the forming package 16 depends upon such factors as the weight of the forming package and portions of the support device 126 to be lifted, and preferably ranges from about $1.4\times10^5$ to about $6.2\times10^5$ Pascals (about 20 to about 90 psia), and more preferably about $2.8\times10^5$ Pascals (about 40 psia).

To retract the piston 138 to move the forming package 16 downwards, the operator 102 actuates the air switch 200 which actuates the pilot operated solenoid power switch to open the check valve 202 and permit all or a portion of the air in the top of tank 136 to flow out of the tank 136. The weight of the forming package 16 and portions of the support device 126 cause the piston to retract which in turn displaces oil from the cylinder 144 into the tank 136. When the operator 102 releases the switch 200, the power switch moves to a neutral predetermined position, the check valve 202 between the tank 136 and cylinder 144 is closed, the tank 136 is vented, and further vertical movement of the forming package 16 is inhibited until the operator 102 actuates the switch 200. The forming package 16 can now be moved horizontally and/or pivoted to any position which the operator 102 desires.

One skilled in the art would understand that other devices such as mechanical screws, electrical linear actuators and hydraulic pumps can be used to move the support device between the first predetermined position 128 and second predetermined position 129. However, an air over oil piston and cylinder arrangement provides several advantages, including precise control and smooth movement of the piston 138 and hence the forming package, low cost, low noise and inexpensive maintenance. It is desirable to avoid abrupt movements of the support device 126 when contacting and moving the forming package 16 to prevent damage of the outer surface 130 of the forming package 16.

The force generated by movement of the piston 138 and rod 149 can be transferred to move the support device 126 in a variety of ways. Preferably, the force is transferred by movement of a cable or preferably a chain 140 which is threaded through a pulley 150 connected by a clevis device to an end of the rod 149 distal to the cylinder 144. The chain 140 has a first end 143 connected or secured to a portion 142 of the support column 70 and a second end 146 connected to a portion 148 of the support device 126. The chain 140 can be connected to the support column 70 and/or support device 126 by any conventional means, such as welding or fastening, for example with a pin.

As shown in FIG. 5, when the piston 138 is extended as discussed above, the pulley 150 (shown on phantom) is moved in a generally vertical direction 154 from a first predetermined location 156 to a second predetermined location 158 spaced apart from and above the first predetermined location 156. The movement of the pulley 150 moves the chain 140 to move the support device 126 connected thereto in the generally vertical direction 154 from the first predetermined position 128 to the second predetermined position 129. When the piston 138 is retracted as discussed above, the pulley 150 is moved in a generally vertical direction 160 generally opposite to the direction 154 from the second predetermined location 158 to the first predetermined location 156. The movement of the pulley 150 in the direction 160 moves the chain 140 to move the support device 126 connected thereto from the second predetermined position 129 to the first predetermined position 128.

The chain 140 is preferably one or more roller or leaf chains formed from links of a rigid material such as stainless steel capable of supporting the weight of the forming package 16 for transport. The overall length 162 of the chain 140 preferably ranges from about 0.6 to about 2 meters, and more preferably about 1.5 meters (about 5 feet). The pitch of the chain can range from No. 35 to No. 80, and is preferably a No. 40 pitch chain. A non-limiting example of a suitable chain useful in the present invention is Model No. 6264K85 stainless steel chain which is commercially available from McMaster Carr Supply Co. of New Brunswick, N.J.

The support device 126 includes a support plate 166, a portion 148 of which is connected to the chain 140. The support plate 166 is formed from a rigid material, such as aluminum or preferably stainless steel. The dimensions of the support plate 166 can vary based upon such factors as the weight of the forming package 16 and other components of the support device to be transported. The length 167 of the support plate 166 can range from about 200 to about 300 mm, and is preferably about 254 mm (about 10 inches). The width 169 of the support plate 166 can range from about 200 to about 500 mm, and is preferably about 432 mm (about 17 inches). The thickness 171 of the support plate 166 (shown in FIG. 1) can range from about 10 to about 20 mm, and is preferably about 13 mm (about ½ inch).

The support plate 166 is slidably connected to and supported by a side walls 73 of the support column 70 facing the winder 14 by one or more roller assemblies 168. The roller assembly 168 preferably comprises one or more rollers 170 connected to the support plate 166 and in sliding engagement with the side walls 73 of the support column 70. Preferably, the support plate 166 is supported by two generally parallel pairs of rollers 170, each of which has a central axis which is generally perpendicular to a central axis 71 of the support column 70, and two generally parallel pairs of rollers 180 (shown in phantom in FIG. 5), each of which has a central axis which is generally parallel to the central axis 71 of the support column 70.

The outer diameter of each roller 170 preferably ranges from about 15 to about 25 mm, and preferably about 19 mm (about ¾ inch). The width of each roller 170 preferably ranges from about 15 to about 25 mm, and preferably about 19 mm (about ¾ inch). Preferably the rollers 170, 180 have self-lubricating flanged bushing bearings such as Model SF16246 which are commercially available from Bearings, Inc. of Pittsburgh, Pa. Other suitable means for slidably connecting the support plate 166 to the support column 70 include ball or roller bearings and slider blocks.

One or more arm(s) 184 are connected to the support plate 166, preferably to side 186 of the support plate 166 opposite the side 187 in facing engagement with the support column 70. Preferably, each of the arms 184 extends from the support plate 166 generally perpendicularly to the central axis 178 of the support column 70 and generally parallel to the rotational axis 40 of the collet 42. As shown in FIG. 5, each of the arms 184 is positioned such that a portion 185 thereof supports the forming package 16 when the support device 126 is in the second position 129. The number of arm(s) 184 can range from 1 to about 6, and preferably the support device 126 has one arm.

The arm 184 is formed from a generally rigid material such as aluminum or preferably stainless steel. The configuration of the arm 184 can be any configuration desired which can support the weight and accommodate the configuration of the forming package 16, such as for example generally cylindrical, tubular, or generally square, I-shaped or preferably rectangular in cross-section. Preferably the arm 184 is generally arc-shaped, as best shown in FIGS. 2 and 5, and has a radius of curvature of about 203 to about 381 mm (about 8 to about 15 inches), and preferably 254 mm (about 10 inches). The length 188 of the arm 184 can range from about 0.5 to about 1.5 meters, and preferably 0.9 meters (about 36 inches). The overall width 190 of the arm 184 can range from about 0.3 to about 0.6 meters, and preferably 0.4 meters (about 14 inches). The thickness 192 of the arm 184 can range from 2 to about 10 mm, and preferably 3.2 mm (about ⅛th inch).

Figure 3:
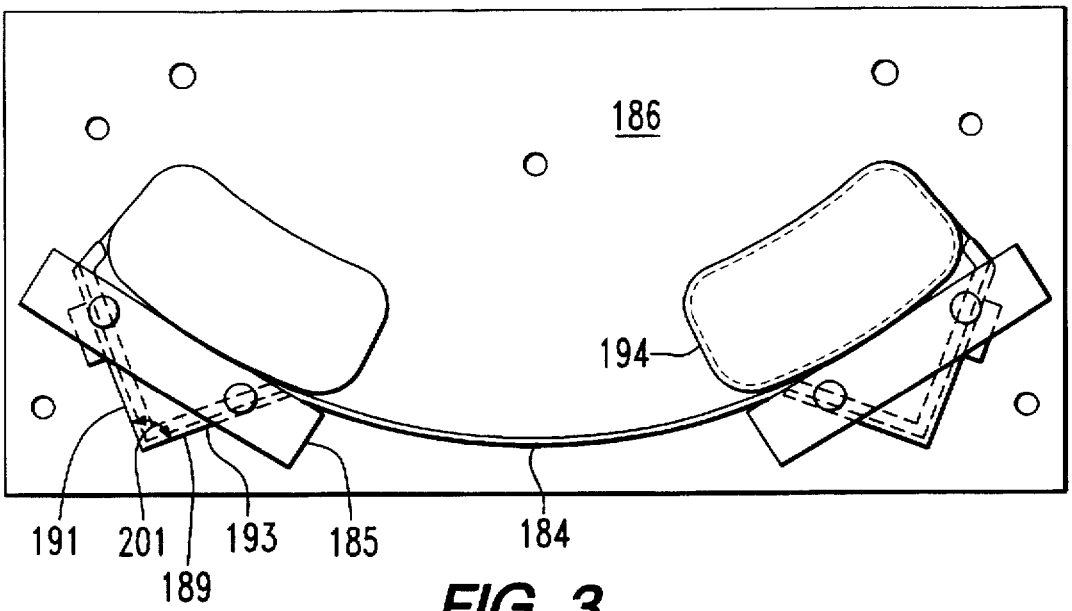
FIG. 3 is a schematic front elevational view of a portion of the apparatus of FIG. 2 showing support members.
Figure 4:
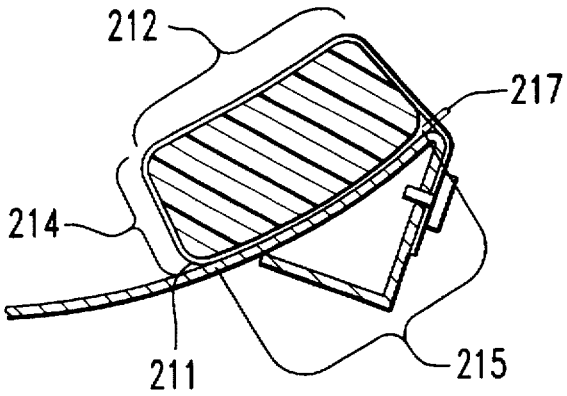
FIG. 4 is a schematic cross-sectional view of a portion of the apparatus of FIG. 1 showing a support member.

The arm(s) 184 can include one or more reinforcing members 189, such as struts or to assist in supporting the weight of the forming package and to increase stability. The length of the reinforcing members 189 can be generally the same or less than the arm 184. Referring to FIGS. 3 and 4, in the preferred embodiment, each reinforcing member 189 has a first side 191 and a second side 193 which intersects the first side at an angle 201, preferably about 90 degrees. Each side 191, 193 supports a portion 185 of the arm 184 discussed above. The reinforcing members 189 can be formed integrally with the arm 184 or from separate rigid materials, as desired.

In a preferred embodiment shown in FIGS. 1–6, the support device 126 comprises at least one or more compressible support member(s) 194 for contacting and supporting at least a portion 134 of the outer surface 130 of the forming package 16 when the support device 126 is in the second predetermined position 129 and for moving the forming package between the first predetermined location 20 and the second predetermined location 22.

Preferably four compressible support members 194, two mounted in parallel on each side of the arm 184, are used to support the forming package 16. The distance 213 (shown in FIG. 6) between each compressible support member on a side of the arm 184 can be about 25 to about 150 mm, and is preferably about 102 mm (about 4 inches). However one skilled in the art would understand that the number of compressible support members can vary from one to about ten depending upon such factors as the dimensions of the compressible support members 194 and physical characteristics of the material from which the compressible support members 194 are formed.

The length 210 of each compressible support member 194 can range from about 50 to about 1000 mm, and is preferably about 254 mm (about 10 inches). The width 212 (shown in FIG. 4) of each compressible support member 194 can range from about 50 to about 500 mm, and preferably about 127 mm (about 5 inches). The thickness 214 of the compressible support member 194 can range from about 25 to about 100 mm, and preferably about 51 mm (about 2 inches). The dimensions of the compressible support member 194 can vary based upon such factors as the number of members 194 to be used and the material from which such members 194 are formed.

The compressible support member 194 can be formed from one or more elastomeric materials which deform when supporting the forming package 16 and recover the pre-deformation shape essentially fully after the weight of the forming package 16 is removed. As used herein, "compressible" means that the support member 194 can be deformed or reduced in size or volume by application of pressure thereto. *See Webster's New Collegiate Dictionary,* (1977) at page 232. As used herein, the terms "deform" and "deformation" mean that the compressible support member 194 can be reduced in size or volume by application of pressure thereto and restored to essentially original size or volume by removal of the pressure applied thereto.

As used herein, "elastomeric material" means that the material is formed from one or more polymers which are capable of recovery from large deformations quickly and forcibly and which have the ability to be stretched to at least twice their original length and to retract very rapidly to approximately its original length when released. See R. Lewis, Sr., *Hawley's Condensed Chemical Dictionary,* (12th Ed. 1993) at page 455 and Kirk-Othmer, *Encyclopedia of Chemical Technology,* Volume 7 (1965) at page 676, which are hereby incorporated by reference.

Preferably the compressible support member 194 is formed from an elastomeric material such as an open-celled flexible cellular plastic or foam material, non-limiting examples of which include cellular rubbers such as expanded natural rubber, expanded butyl rubber and expanded styrene-butadiene rubber, latex foam rubbers, polyurethanes, poly(vinyl chlorides), expanded acrylonitrile-butadiene elastomers and silicones. Suitable cellular plastic materials and methods for forming the same are discussed in Kirk-Othmer, *Encyclopedia of Chemical Technology,* Vol. 9 (2d Ed. 1966) at pages 847–884 and *Encyclopedia of Polymer Science and Technology,* Vol. 3 (1965) at pages 80–130, which are hereby incorporated by reference.

The preferred elastomeric material is FOAMEX, an open-celled polyurethane which is commercially available as No. 8643K42 from McMaster Carr. This material has a density of about 0.045 grams per cubic centimeter (about 2.8 pounds per cubic foot) and supports about 1655 Pascal (about 0.24 psia) load at 25% deflection.

Suitable elastomeric materials preferably can support a load at 25% deflection ranging from about 1379 Pascals (about 0.2 psia) to about 6895 Pascals (about 1 psia). The selection of a suitable compressible material depends upon factors such as the weight of the forming package 16.

Preferably the compressible support members 194 are mounted upon or attached to a pad 211 which is connected to the arm 184 for inhibiting movement of the compressible support members 194 during use. The compressible support members 194 can be attached to the pad 211 by any conventional adhesive. The pad 211 can be attached to the arm 184 by any conventional adhesive. The pad 211 is preferably a closed-cell elastomeric material such as are discussed above having a load at 25% deflection which is greater than the load at 25% deflection for the compressible support member 194. Preferably the load at 25% deflection for the pad 211 ranges from about 13790 to about 34474 Pascals (about 2 to about 5 psia). The preferred pad 211 is formed from a blend of neoprene, styrene-butadiene rubber and ethylene-propylene diene monomer such as is comercially available as Model 8647K23 from McMaster Carr.

The length of the pad 211 can range from about 50 to about 3000 mm, and is preferably about 610 mm (about 24 inches). The width 215 of the pad 211 is generally about the same as the width 212 of the compressible support member 194 discussed above. The thickness 217 of the pad 211 can range from about 5 to about 20 mm, and preferably about 6.4 mm (about ¼ inch).

In an alternative preferred embodiment shown in FIG. 7, the compressible support member is a fluid-filled bladder 724 which can be inflated to a predetermined position 725 prior to the bladder 724 contacting the outer surface 726 of the forming package 716. As used herein, the term "fluid" means air or any liquid which resists compression, such as water or glycerine. The bladder 724 receivably accommodates the forming package 716 when the support device 728 is in the second position and when the transport apparatus 718 is transporting the forming package between the first location 720 and second location 722.

The outer surface 730 of the bladder 724 is impervious to the fluid to be contained therein, such that the fluid is retained in the bladder 724 when the forming package 716 weight is positioned thereon without leaking. Suitable flexible materials for the bladder 724 include canvas reinforced with a thermoplastic material.

The dimensions of the bladder 724 can vary based upon such factors as the dimensions and weight of the forming package 716 and preferably correspond generally to the dimensions of the arm 184 discussed above.

In another alternative embodiment shown in FIGS. 8–12, a transport apparatus 800 according to the present invention is shown in which the support device 810 comprises one or arm(s) 812 which are connected to the support plate 814, preferably to side 816 of the support plate 814 opposite the side 818 in facing engagement with the support column 820. Preferably, each of the arms 812 extends from the support plate 814 generally perpendicularly to the central axis 822 of the support column 820 and generally parallel to the rotational axis of the collet (not shown). Each of the arms 812 is positioned such that a portion 813 thereof supports the forming package 828 when the support device 810 is in the second predetermined position. The number of arm(s) 812 can range from 1 to about 6, and preferably the support device 810 has two arms.

Each arm 812 is formed from similar materials as the arms 184 discussed above. Each arm 812 preferably comprises one or more plates which extend generally the length of the forming package 828 and to which the extendible support member(s) 830 are attached. The thickness of each plate ranges from about 1 to about 5 mm. The plate and extendible support member(s) 830 attached thereto are preferably covered with a flexible polymeric sleeve to prevent damage to the outer layers of the forming package 828.

As shown in FIGS. 8–12, the support device 810 comprises at least one or more extendible support member(s) 830 for contacting and supporting at least a portion 832 of the outer surface 834 of the forming package 828 when the support device 810 is in the second predetermined position and for moving the forming package 828 between the first predetermined location and the second predetermined location.

Preferably four extendible support members 836, 838, each mounted to a separate arm 812, are used to support the forming package 828. However one skilled in the art would understand that the number of extendible support member(s) can vary from two to about five depending upon such factors as the dimensions of the extendible support members 830 and physical characteristics of the material from which the extendible support members 830 are formed.

The extendible support member 830 is preferably a hydraulic or pneumatic piston and cylinder arrangement 840, for example a double acting, double end rod pneumatic piston and cylinder having a two inch stroke such as is commercially available as Model FOD from Bimba, Inc. of Monel, Ill. Other suitable piston and cylinder arrangements are well known to those skilled in the art.

The length 842 of the extendible support member 830 can range from about 50 to about 100 mm, and is preferably about 76 mm (about 3 inches). The diameter 844 of the extendible support member 830 can range from about 50 to about 100 mm, and is preferably about 76 mm (about 3 inches). The dimensions of the extendible support member 830 can vary based upon such factors as the number of members 830 to be used and the dimensions and weight of the forming package 828 to be transported. The air supply to the cylinder preferably ranges from about 137895 to about 413686 Pascals (about 20 to about 60 psia).

As shown in FIGS. 8–12, the transport apparatus 800 can be mounted upon a cart 846 which is movable by an operator (not shown) manually or automatically between the first location and the second location as discussed above.

Figure 8:
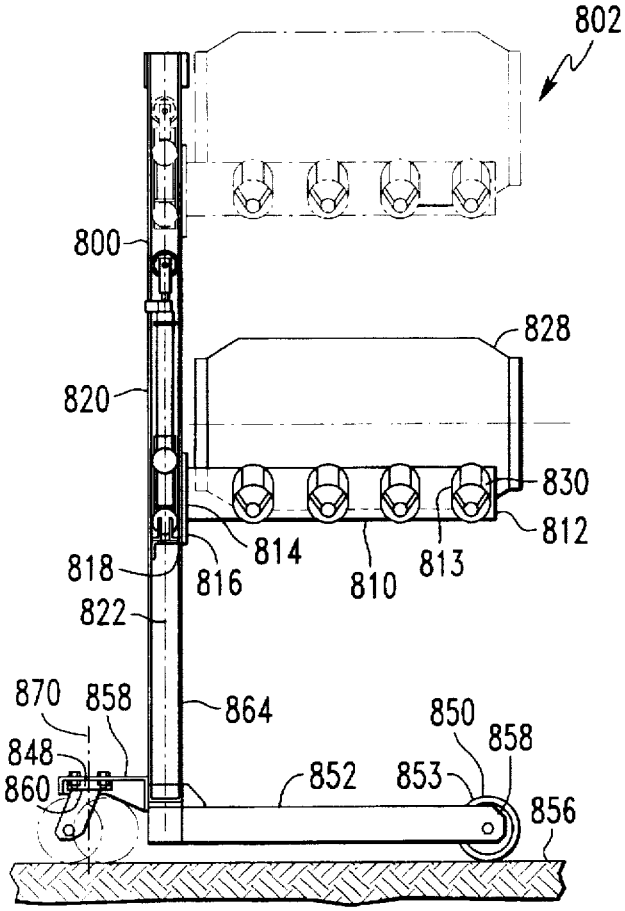
FIG. 8 is a schematic side elevational view of another alternative embodiment of an apparatus for mechanically transporting a generally cylindrical package, in accordance with the present invention.
Figure 9:
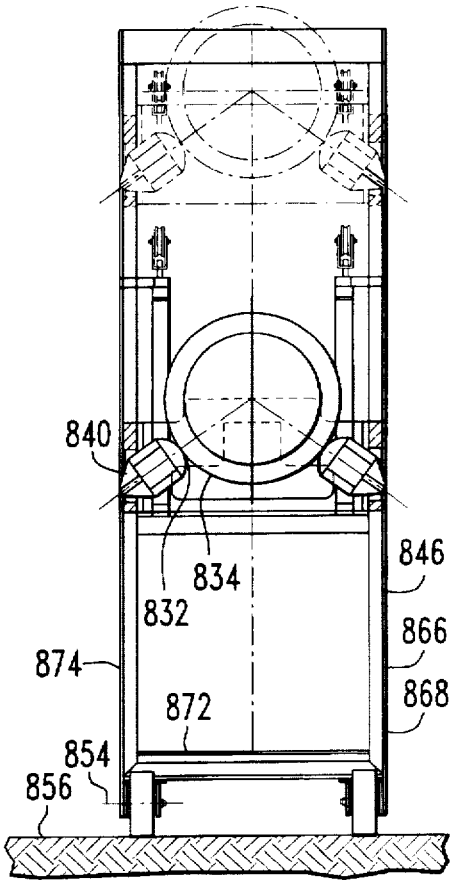
FIG. 9 is an end view of the apparatus of FIG. 8.

Referring now to FIGS. 2, 7 and 8, the frame 68, 711, 864 of the transport apparatus 18, 718, 800 comprises a pivot device 216, 744, 848 which permits the support device 126, 728, 810 to be pivoted about the generally vertical longitudinal axis 71, 746, 870. Preferably, the pivot device 216, 744, 848 permits the support device 126, 728, 810 to be pivoted 360° about the generally vertical longitudinal axis 71, 746, 870, and more preferably greater than 90° to about 180°.

Preferably, the pivot device 216, 744 comprises a roller bearing assembly 218, 748 connected to the support column 70. In the preferred embodiment shown in FIGS. 1–6, the roller bearing assembly 218, 748 is connected to the top end 220 of the support column 70. In the alternative embodiment shown in FIG. 7, the roller bearing assembly 218, 748 is connected to the bottom end 750 of the support column 70.

The roller bearing assembly 218, 748 should be capable of supporting the weight of the forming package 16, 716 and the other components of the frame 68, 706, preferably at least about 1000 pounds. A preferred roller bearing assembly 218, 748 is commercially available as Model 40606 from Zimmerman International Corp. of Madison Heights, Mich. Other useful bearing assemblies are commercially available from Scaglia America, Inc. of Charlotte, N.C.

In another alternative embodiment shown in FIGS. 8–12, the pivot device 848 comprises one or more roller assemblies 850 connected to the bottom 852 of the cart 846. Each roller assembly 850 includes a rotatable roller 853 having a longitudinal rotational axis 854 which is generally parallel to the ground 856, a bracket 858 connected to each end of the axis 854 and a pivot assembly 860 about which the cart 846 can be pivoted, such as a roller bearing which connects the bracket 858 to the bottom 852 of the frame 864. The diameter of each roller 853 preferably ranges from about 100 to about 200 mm, and is preferably about 152 mm (about 6 inches). The width of each roller 853 preferably ranges from about 20 to about 100 mm, and is preferably about 51 mm (about 2 inches). Suitable rollers 853 having self-lubricating bushing bearings are discussed above.

Referring now to FIGS. 1–12, the transport apparatus 18, 718, 800 comprises a carriage assembly 104, 752, 866 connected to the pivot device 216, 744, 848 and supporting the frame 68, 706, 864. The carriage assembly 104, 752, 866 comprises a carriage 222, 754, 868 for (1) moving the frame 68, 706, 864 between winders 14, 756 in the direction 80 and the opposed direction 82 (best shown in FIGS. 2 and 5) such that the support column 70, 758, 820 can be aligned with each winder 14, 756 to remove the respective wound package 16, 716, 828 telescoped thereon and (2) for moving the frame 68, 706, 864 between (a) the first predetermined position 110, 760 proximate the support or winder 14, 756 for removing the wound package 16, 716 from the winder 14, 756 at the first predetermined location 20, 720 and (b) the second predetermined position 112, 762 horizontally and, if desired, vertically, spaced apart from the first predetermined position 110, 760 and winder 14, 756 at which the wound package 16, 716 can be unloaded from the transport apparatus 18, 718 at the second predetermined location 22, 764 onto the storage device, as best shown in FIGS. 1, 6 and 7.

In a preferred embodiment shown in FIGS. 1–6, the carriage assembly 104 is a trolley 224 and rail system 226 which is commercially available as Model ZRA2 from Zimmerman International Corp. of Madison Heights, Mich. Referring to FIG. 5, the trolley 224 preferably comprises a framework 228 of a rigid material, such as steel or aluminum, from which the frame 68 is suspended by securing a portion 230 of the pivot device 216 thereto. The portion 230 of the pivot device 216 can be secured to the framework 228 by welding, screws, nuts and bolts, or any other fastening means well known to those skilled in the art.

The length 232 and width 234 of the framework 228 can vary based upon such factors as the weight and dimensions of the forming package 16 and the frame 68. The length 232 of the framework 228 preferably ranges from about 0.5 to about 1.5 meters, and is preferably about 1 meter (about 41 inches). The width 234 of the framework 228 preferably ranges from about 0.5 to about 1.5 meters, and is preferably about 0.8 meters (about 30 inches).

Referring to FIG. 2, the trolley 224 preferably comprises one or more primary roller assemblies 236 for moving the support device 126 between the first predetermined position 110, 760 and the second predetermined position 112, 762. Each primary roller assembly 236 comprises a bracket 238 to which the framework 228 is connected, preferably by welding or a fastening means such as a pin. The bracket 238 of each primary roller assembly 236 is preferably connected to an axis of rotation 240 of one or more primary rollers 242, and preferably three pairs of primary rollers 242. The diameter 244 of each primary roller 242 preferably ranges from about 50 to about 100 mm, and is preferably about 76 mm (about 3 inches). The width 246 of each primary roller 242 preferably ranges from about 10 to about 20 mm, and is preferably about 13 mm (about 0.5 inches). Preferably the primary rollers 242 have self-lubricating bushing bearings. A preferred primary roller assembly 236 is commercially available as Model ZRA2 reaction trolley from Zimmerman International Corp. of Madison Heights, Mich.

The primary rollers 242 are suspended from and in sliding engagement with one or more primary rails 248, best shown in FIGS. 2 and 5. Preferably a single primary rail is used in the preferred embodiment, although the number of rails can vary as desired. The primary rail 248 is formed from a rigid material such as steel or preferably aluminum. As shown in FIG. 1, the length 250 of the primary rail 248 preferably ranges from about 2 to about 6 meters, and is preferably about 2.7 meters (about 9 feet) and can vary based upon such factors as the number of winders 16 which the system 10 services and the distance between each winder 16. The overall width 252 of each primary rail 248 preferably ranges from about 75 to about 125 mm, and is preferably about 100 mm.

Each primary rail 248 has body 253 having flanges 254 at the top 259 and bottom 255 thereof along a longitudinal axis 256 thereof. The primary roller assembly 236 is positioned upon the primary rail such that the body 253 is between each pair of primary rollers 242 such that the trolley 224 is retained thereon yet permitted to slide along the length of the primary rail 248 for moving the frame 68 in a direction 266 between the first predetermined position 110 proximate the support or winder 14 for removing the wound package 16 at the first predetermined location 20 therefrom and the second predetermined position 112 horizontally spaced apart from the first predetermined position 110 and winder 14 at which the wound package 16 can be unloaded at the second predetermined location 22. The width of the flanges 254 is preferably greater than the width of the corresponding primary rollers 242.

The top 259 of the primary rail 248 has connected thereto a mounting bracket 262 for connecting the primary rail 248 to a secondary roller assembly 264. The mounting bracket 262 can be connected to the primary rail 248 by any conventional connecting means, such as by welding or fastening means.

Referring to FIG. 5, preferably the secondary roller assembly 264 comprises a bracket 257 to which the primary rail 248 is connected, preferably by welding or a fastening means such as a pin. The bracket 257 of each secondary roller assembly 264 is preferably connected to an axis of rotation 261 of one or more secondary rollers 268, and preferably two pairs of secondary rollers 268. The dimensions and configuration of each secondary roller 268 are generally similar to those of the primary rollers 242 discussed in detail above. A preferred secondary roller assembly 264 is commercially available as Model ZRA2 end truck assembly from Zimmerman International Corp. of Madison Heights, Mich.

The secondary roller assembly 264 permits the frame 68 to be moved in the direction 80 or opposite direction 82 to any position, such as first position 84, second position 90 or third position 96, along the length 250 of the secondary rail 270 generally perpendicularly to the rotational axis 40 of the collet 42 manually by the operator or automatically by a signal from the operator 102 to a suitable motor assembly connected thereto.

The secondary rollers 268 of the secondary roller assembly 264 are suspended from and in sliding engagement with one or more secondary rails 270, best shown in FIGS. 1 and 6. Preferably one secondary rail 270 is used in the preferred embodiment, although the number of rails can vary as desired. The secondary rails 270 can be similar in configuration and dimensions to the primary rails 248 discussed above, although preferably the secondary rails 270 have enclosed sides. The length of each secondary rail 270 preferably ranges from about 5 to about 20 meters, and is preferably about 9.1 meters (about 30 feet), and can vary based upon such factors as the distance between winders.

The secondary rollers 268 are positioned within the channel 276 of the secondary rail 270 and can be moved in the direction 266 or opposite direction 267 to any position along the length of the secondary rail 270 generally perpendicularly to the rotational axis 40 of the collet 42 manually by the operator or automatically by a signal from the operator 102 to a suitable motor assembly connected thereto.

Each end of the rails 248, 270 preferably has a stop 249 at either end thereof to prevent the rollers 242, 268 from leaving the ends of the rails 248, 270.

The top side 278 of the secondary rail(s) 270 is connected to a main support beam 280 which is connected to and supported by the ground 23, either directly or through other support apparatus. The top side 278 of the secondary rail(s) 270 is connected to the main support beam 280 by welding or other suitable fastening means well known to those skilled in the art.

In the alternative embodiments shown in FIGS. 7 and 8–12, the carriage 754, 868 comprises a support member 766, 872 connected to the bottom end 750, 874 of the support column 758, 820. The support member 766, 872 can be formed from any rigid material such as steel or preferably aluminum. The length and width of the support member 766, 872 can vary based upon such factors as the weight and dimensions of the forming package 16 and the frame 68. The length of the support member 766, 872 preferably ranges from about 0.5 to about 1.5 meters, and is preferably about 0.9 meters (about 3 feet). The width of the support member 766, 872 preferably ranges from about 0.5 to about 1 meter, and is preferably about 0.7 meters (about 28 inches).

The carriage 754, 868 preferably comprises one or more roller assemblies 770, 850, each roller assembly 770, 850 comprising a bracket 772, 858 to which the support member 766, 872 is connected, preferably by welding or a fastening means such as a pin. The bracket 772, 858 of each roller assembly 770, 850 is preferably connected to an axis of rotation of one or more, and preferably two, rollers 774, 853. The diameter of each roller 774, 853 preferably ranges from about 50 to about 150 mm. The width of each roller 774, 853 preferably ranges from about 10 to about 50 mm. Preferably the rollers 774, 853 have self-lubricating bushing bearings.

The rollers 774, 853 are supported by and in sliding engagement with the ground 723, 856. If desired, the rollers 774, 853 can ride upon rails 778 such as are discussed in detail above.

The system 10, 710, 802 can further comprise one or more storage devices, such as cart 114 (shown in FIG. 6) or conveyor 715 (shown in FIG. 7) for further transport or storage, as discussed above. The conveyor 715 or cart 114 include at least one support or arm 282, 780 for receiving and retaining the forming package 16, 716 at the second location 22, 722. Preferably the arm 282, 780 is configured such that the forming package 16, 716 can be telescoped thereon by aligning the aperture 290, 782 of the forming package 16 with the arm 282, 780 and sliding the forming package onto the arm 282, 780 and lowering the support device 126, 728 such that the weight of the package 16, 716 is supported by the arm 282, 780. The cart or conveyor can then be moved manually or by a signal from the operator 102 to move the forming package to a third location 292, 784 spaced apart horizontally and/or vertically from the second location 22, 722. One skilled in the art would understand that similar storage devices can be used for the system 802 shown in FIGS. 8–12.

Non-limiting examples of suitable conveyors include those which are commercially available from Babcock & Wilcox. Other useful conveyors are discussed in Loewenstein at pages 215–219, which are hereby incorporated by reference.

The configuration of the cart 114 should provide sufficient integrity to permit one or more forming packages 16, 716, 828 to be retained thereon. The arms 282 of the cart 114 are preferably supported by a generally vertical column 294 connected to and supported by one or more cross members 296, the length of the column should be sufficient to position the arm 282 at the desired height. The number and configuration of the cross members 296 should be that which is sufficient to stably support the load of forming packages 16 positioned thereon. The length of the cross members 296 can range from about 1 to about 2 meters. Any conventional cart well known to those skilled in the art having generally horizontal arms to receive the forming packages 16 can be used in accordance with the present invention.

The methods according to the present invention for transporting a generally cylindrical package from a first predetermined location to a second predetermined location horizontally spaced apart from the first predetermined location will now be described generally.

With reference to FIGS. 1–7, the preferred method generally comprises the initial step of providing a generally cylindrical package removably telescoped upon a generally horizontal member of a support at a first predetermined location.

In the preferred embodiment, the fibers are supplied to the system by drawing the fibers from a fiber forming apparatus, as shown in FIG. 1. A sizing composition can be applied to the fibers by an applicator device. The fibers can be gathered into groupings or strands by an alignment device, as discussed above. In an alternative embodiment shown in FIG. 7, the strands are supplied to the system from a plurality of fiber supply packages. The strands are wound upon a collet of a winder to form a wound package.

After winding has ceased, the support device of the transport apparatus is positioned at a predetermined position spaced apart from and below an outer surface of the generally cylindrical package. The support device is moved from the predetermined position in a first direction along a generally vertical axis such that the compressible support member (or in the alternative, the extendible support member) contacts and supports at least a portion of the outer surface of the generally cylindrical package at a second predetermined position. An advantage of the transport apparatus of the present invention is that by selecting an appropriate air pressure supply to the piston and cylinder arrangement, the contact pressure between the support device and the package can be controlled to prevent damage to the exterior of the package. Also, since the support device can be moved generally perpendicularly to the generally horizontal member or collet of the support, the operator can compensate for imprecise alignment with the package to be removed.

The support device is moved from the second predetermined position in a second direction along a generally horizontal axis away from the support such that the generally cylindrical package is removed from the support. The is support device can be pivoted about a generally vertical axis at a predetermined angle, preferably about 180°. If desired, the support device can be moved along a generally vertical axis to raise or lower the forming package thereon to align the forming package with the support. At least a portion of the generally cylindrical package is positioned upon a generally horizontal member of a support at a third predetermined position. The generally cylindrical package is released from the support device, such that the generally cylindrical package is transported to a second predetermined location horizontally spaced apart from the first predetermined location.

The method of the present invention is not limited to use in transporting forming packages, but can also be useful in for transporting any generally cylindrical package, such as a wound package of a sheet material.

The operation of the system to perform the method according to the present invention will now be described. However, other apparatus than that shown and described herein could be used to perform the methods of the present invention, if desired.

In the initial sequence of operation of the preferred embodiment, fibers are drawn from a fiber forming apparatus and preferably coated with a sizing composition and gathered into a plurality of strands by an alignment device. In an alternative embodiment, supply packages are positioned in the creel and the fibers from the supply packages are gathered into a plurality of strands by an alignment device. The strands are wound about the collet of a winder. After the winding operation has ceased, an operator positions the support device of the transport apparatus at a predetermined position spaced apart from and below an outer surface of the generally cylindrical package. The operator moves the support device from the predetermined position in a first direction along a generally vertical axis such that the compressible support member (or in the alternative, the extendible support member) contacts and supports at least a portion of the outer surface of the generally cylindrical package at the second predetermined position.

The operator moves the support device from the second predetermined position in a second direction along a generally horizontal axis away from the support such that the generally cylindrical package is removed from the support. The operator can pivot the support device about a generally vertical axis at the predetermined angle, preferably about 180°. The operator positions at least a portion of the generally cylindrical package upon the support, such as the arm of the conveyor or cart, at a third predetermined position. The operator lowers the support device to release the generally cylindrical package from the support device, such that the generally cylindrical package is transported to a second predetermined location horizontally spaced apart from the first predetermined location.

The apparatus, systems and methods of the present invention permit removal and transport of generally cylindrical packages with minimal damage the outer surface of the package and provide ergonomically efficient means or moving large, cumbersome and unwieldy packages in a stable manner.

The apparatus, systems and methods of the present invention will now be illustrated by the following specific, non-limiting example.

EXAMPLE

Forming packages of (a) 0.3 meters (about 12 inches) diameter and 0.36 meters (about 14 inches) length weighing 88 kilograms (about 40 pounds) and (b) 0.3 meters (about 12 inches) diameter and about 0.7 meters (about 28 inches) length weighing about 330 kilograms (about 150 pounds) were removed from a collet such as is described above and transported using the preferred transport apparatus such as is shown in FIGS. 1–6 and as discussed above a generally horizontal distance of about 9 feet. The air pressure charged to the cylinder and piston arrangement used to remove the forming packages was about $2.8\times10^5$ Pascals (about 40 psia).

The support device of the transport apparatus used four compressible support members of FOAMEX material, an open-celled polyurethane which is commercially available as No. 8643K42 from McMaster Carr. This material supports about 1655 Pascal (about 0.24 psia) load at 25% deflection. The compressible support members were mounted in parallel pairs upon the arm, which had a radius of curvature of about 254 mm (about 10 inches). The distance between each compressible support member on a side of the arm was about 102 mm (about 4 inches).

The compressible support members were attached by an adhesive to a pad 211 which was connected to the arm. The pad was a blend of neoprene, styrene-butadiene rubber and ethylene-propylene diene monomer comercially available as Model 8647K23 from McMaster Carr.

From the foregoing description, it can be seen that the present invention provides a simple, economical system and process for manipulating and transporting wound packages to reduce labor and waste disposal costs and increase efficiency and productivity.

It will be appreciated by those skilled in the art that changes could be made to the embodiments described above without departing from the broad inventive concept thereof. It is understood, therefore, that this invention is not limited to the particular embodiments disclosed, but it is intended to cover modifications which are within the spirit and scope of the invention, as defined by the appended claims.

Therefore, we claim:

1. An apparatus for transporting a generally cylindrical package from a first predetermined location to a second predetermined location horizontally spaced apart from the first predetermined location, the apparatus comprising:

(a) a frame comprising a support device comprising at least one compressible support member and a pivot device for pivoting the support device about a generally vertical axis, the support device being movable along the generally vertical axis between (1) a first predetermined position spaced apart from and below an outer surface of a generally cylindrical package which is removably telescoped upon a generally horizontal member of a support at a first predetermined location and (2) a second predetermined position in which the compressible support member contacts, is compressed and supports at least a portion of the outer surface of the generally cylindrical package; and (b) a carriage assembly connected to and supporting the frame, the carriage assembly comprising a carriage for moving the frame between (1) a first predetermined position proximate the support and (2) a second predetermined position horizontally spaced apart from the first predetermined position such that the generally cylindrical package is removed from the first predetermined location upon the generally horizontal member of the support and transported to a second predetermined location horizontally spaced apart from the first predetermined location.

2. The apparatus according to claim 1, wherein the compressible support member comprises an elastomeric material.

3. The apparatus according to claim 2, wherein the elastomeric material is selected from the group consisting of polyurethanes, poly(vinyl chlorides), latex foam rubbers, acrylonitrile-butadiene elastomers, natural rubbers, butyl rubber, styrene-butadiene rubbers and silicone.

4. The apparatus according to claim 3, wherein the elastomeric material is an open-celled polyurethane material.

5. The apparatus according to claim 1, wherein the compressible support member comprises an inflatable bladder.

6. The apparatus according to claim 1, wherein the pivot device comprises a roller bearing assembly having a plurality of roller bearings.

7. The apparatus according to claim 1, wherein the support device is moveable along a generally vertical axis between a third predetermined position in which the generally cylindrical package is aligned with a storage device and a fourth predetermined position in which the generally cylindrical package is released from the support device and positioned upon the storage device.

8. The apparatus according to claim 1, wherein the carriage assembly further comprises a rail system for receiving the carriage and guiding the carriage from the first predetermined position proximate the support to the second predetermined position horizontally spaced apart from the first predetermined position.

9. The apparatus according to claim 8, wherein the rail system comprises at least one rail.

10. The apparatus according to claim 8, wherein the carriage is suspended from the rail.

11. The apparatus according to claim 8, wherein the carriage is supported by the rail.

12. An apparatus for transporting a generally cylindrical wound package from a first predetermined location to a second predetermined location horizontally spaced apart from the first predetermined location, the apparatus comprising:

(a) a frame comprising a support device comprising at least one compressible support member and a pivot device for pivoting the support device about a generally vertical axis, the support device being movable along the generally vertical axis between (1) a first predetermined position spaced apart from and below an outer surface of a generally cylindrical wound package which is removably telescoped upon a generally horizontal collet of a winder at a first predetermined location and (2) a second predetermined position in which the compressible support member contacts, is compressed and supports at least a portion of the outer surface of the generally cylindrical wound package; and (b) a carriage assembly connected to and supporting the frame, the carriage assembly comprising a carriage for moving the frame between (1) a first predetermined position proximate the winder and (2) a second predetermined position horizontally spaced apart from the first predetermined position such that the generally cylindrical package is removed from the first predetermined location upon the generally horizontal collet of the winder and transported to a second predetermined location horizontally spaced apart from the first predetermined location.

13. A system for transporting a generally cylindrical package from a first predetermined location to a second predetermined location horizontally spaced apart from the first predetermined location, the system comprising:

(a) a support having a generally horizontal member;

(b) a generally cylindrical package which is removably telescoped upon at least a portion of the generally horizontal member of the support at a first predetermined location;

(c) an apparatus for transporting the generally cylindrical package from the first predetermined location to a second predetermined location spaced apart from the first predetermined location, the apparatus comprising:

(i) a frame comprising a support device comprising at least one compressible support member and a pivot device for pivoting the support device about a generally vertical axis, the support device being movable along the generally vertical axis between (1) a first predetermined position spaced apart from and below an outer surface of the generally cylindrical package and (2) a second predetermined position in which the compressible support member contacts, is compressed and supports at least a portion of the outer surface of the generally cylindrical package; and (ii) a carriage assembly connected to and supporting the frame, the carriage assembly comprising a carriage for moving the frame between (1) a first predetermined position proximate the support and (2) a second predetermined position horizontally spaced apart from the first predetermined position such that the generally cylindrical package is removed from the first predetermined location upon the generally horizontal member of the support and transported to a second predetermined location horizontally spaced apart from the first predetermined location.

14. The system according to claim 13, wherein the support is a winder, the generally horizontal member is a collet of the winder and the generally cylindrical package is a wound forming package of glass fibers.

15. The system according to claim 13, wherein the carriage assembly further comprises a rail system for receiving the carriage and guiding the carriage from the first predetermined position proximate the support to the second predetermined position horizontally spaced apart from the first predetermined position.

16. The system according to claim 13, further comprising a storage device located at a predetermined position for receiving the generally cylindrical package from the support device and retaining the generally cylindrical package at the second predetermined location.

17. An apparatus for transporting a generally cylindrical package from a first predetermined location to a second predetermined location horizontally spaced apart from the first predetermined location, the apparatus comprising:

(a) a frame comprising a support device comprising a plurality of extendible support members and a pivot device for pivoting the support device about a generally vertical axis, the support device being movable along the generally vertical axis between (1) a first predetermined position spaced apart from and below an outer surface of a generally cylindrical package which is removably telescoped upon a generally horizontal member of a support at a first predetermined location and (2) a second predetermined position in which the extendible support members are extended to contact, lift the generally cylindrical package from the generally horizontal member of the support, and support at least a portion of the outer surface of the generally cylindrical package; and (b) a carriage assembly connected to and supporting the frame, the carriage assembly comprising a carriage for moving the frame between (1) a first predetermined position proximate the support and (2) a second predetermined position horizontally spaced apart from the first predetermined position such that the generally cylindrical package is removed from the first predetermined location upon the generally horizontal member of the support and transported to a second predetermined location horizontally spaced apart from the first predetermined location.

18. The apparatus according to claim 17, wherein each extendible support member comprises at least one piston and cylinder arrangement.

19. A system for transporting a generally cylindrical package from a first predetermined location to a second predetermined location horizontally spaced apart from the first predetermined location, the system comprising:

(a) a support having a generally horizontal member;

(b) a generally cylindrical package removably telescoped upon at least a portion of the generally horizontal member;

(c) an apparatus for transporting the generally cylindrical package from a first predetermined location to a second predetermined location horizontally spaced apart from the first predetermined location, the apparatus comprising:

(i) a frame comprising a support device comprising a plurality of extendible support members and a pivot device for pivoting the support device about a generally vertical axis, the support device being movable along the generally vertical axis between (1) a first predetermined position spaced apart from and below an outer surface of the generally cylindrical package and (2) a second predetermined position in which the extendible support members are extended to contact, lift the generally cylindrical package from the generally horizontal member of the support, and support at least a portion of the outer surface of the generally cylindrical package; and (ii) a carriage assembly connected to and supporting the frame, the carriage assembly comprising means for moving the frame between (1) a first predetermined position proximate the support and (2) a second predetermined position horizontally spaced apart from the first predetermined position such that the generally cylindrical package is removed from the first predetermined location upon the generally horizontal member of the support and transported to a second predetermined location horizontally spaced apart from the first predetermined location.

20. A method for transporting a generally cylindrical package from a first predetermined location to a second predetermined location horizontally spaced apart from the first predetermined location, comprising the steps of:

(a) providing a generally cylindrical package removably telescoped upon a generally horizontal member of a support at a first predetermined location;

(b) positioning a support device of a transport apparatus at a predetermined position spaced apart from and below an outer surface of the generally cylindrical package, the support device comprising at least one compressible support member;

(c) moving the support device from the predetermined position in a first direction along a generally vertical axis such that the compressible support member contacts, is compressed and supports at least a portion of the outer surface of the generally cylindrical package at a second predetermined position;

(d) moving the support device from the second predetermined position in a second direction along a generally horizontal axis away from the support such that the generally cylindrical package is removed from the support;

(e) pivoting the support device about a generally vertical axis at a predetermined angle;

(f) positioning at least a portion of the generally cylindrical package upon a support at a third predetermined position; and (g) releasing the generally cylindrical package from the support device, such that the generally cylindrical package is transported to a second predetermined location horizontally spaced apart from the first predetermined location.

21. A method for transporting a generally cylindrical package, comprising the steps of:

(a) providing a generally cylindrical package removably telescoped upon a generally horizontal member of a support at a first predetermined location;

(b) positioning a support device of a transport apparatus at a predetermined position spaced apart from and below an outer surface of the generally cylindrical package, the support device comprising a plurality of extendible support members;

(c) moving the support device from the predetermined position in a first direction along a generally vertical axis such that the extendible support members contact at least a portion of the outer surface of the generally cylindrical package at a second predetermined position;

(d) extending the extendible support members to contact and lift the generally cylindrical package from the generally horizontal member of the support, such that the extendible support members support at least a portion of the outer surface of the generally cylindrical package;

(e) moving the support device from the second predetermined position in a second direction along a generally horizontal axis away from the support such that the generally cylindrical package is removed from the support;

(f) pivoting the support device about a generally vertical axis at a predetermined angle;

(g) positioning at least a portion of the generally cylindrical package upon a support at a third predetermined position; and (h) releasing the generally cylindrical package from the support device, such that the generally cylindrical package is transported to a second predetermined location horizontally spaced apart from the first predetermined location.

* * * * *